US006811440B1

(12) United States Patent
Rothermel et al.

(10) Patent No.: US 6,811,440 B1
(45) Date of Patent: Nov. 2, 2004

(54) POWER CONNECTOR

(75) Inventors: Brent Ryan Rothermel, Harrisburg, PA (US); Alex Michael Sharf, Harrisburg, PA (US); Douglas W. Glover, Dauphin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/652,956

(22) Filed: Aug. 29, 2003

(51) Int. Cl.[7] ..... H01R 9/22
(52) U.S. Cl. ..... 439/608
(58) Field of Search ..... 439/608, 79, 108, 439/692

(56) References Cited

U.S. PATENT DOCUMENTS 4,861,272 A 8/1989 Clark ..... 439/79
5,066,236 A 11/1991 Broeksteeg ..... 439/79
6,293,827 B1 * 9/2001 Stokoe ..... 439/608
6,379,188 B1 4/2002 Cohen et al. ..... 439/608
6,705,902 B1 * 3/2004 Yi et al. ..... 439/678
2003/0228776 A1 * 12/2003 Egan et al. ..... 439/79

* cited by examiner

*Primary Examiner*—Renee Luebke

(57) ABSTRACT

An electrical connector includes a housing and at least one electrical wafer that is receivable in the housing. The wafer has a first edge and a second edge that intersect each other and an array of conductive paths between the first and second edges. Each conductive path has a resistance between the first and second edges that is substantially equal.

20 Claims, 4 Drawing Sheets

POWER CONNECTOR

BACKGROUND OF THE INVENTION

The invention relates generally to electrical connectors and, more particularly, to a right angle power connector.

In some electrical applications, computers being one example, circuit components such as daughter boards are connected to other circuit boards called backplanes, to which other circuit boards or electrical devices can connected. Often, these components are oriented with respect to each other such that a right angle connection is desired. Though many right angle connectors are in use, obstacles exist with using right angle connectors, particularly power connectors. In a straight connector, a number of current paths across the connector are typically all the same length, so that there is a uniform current path across the connector. In a right angle connector, however, some current paths are typically longer than others.

Typical right angle power connectors have a single copper path that is as large as possible to lower resistance. Whether the connector has a single contact or multiple discrete contacts, current flow will take the path of least resistance, which is usually the shortest path. At the backplane interface, one or more power planes beyond the backplane contact are provided that are as large as possible to handle the current load.

The low resistance flow path on the right angle connector will draw more current flow than other flow paths. This increased current flow leads to more heat being produced in the contacts of the low resistance path, both in the power connector and the interfacing connector that is receiving the current. The heat can potentially build to a point where the interface connection deteriorates, or in a worse case scenario, a catastrophic failure occurs in the interface contacts.

BRIEF DESCRIPTION OF THE INVENTION

In one embodiment of the invention, an electrical connector is provided that includes a housing and at least one electrical wafer that is receivable in the housing. The wafer has a first edge and a second edge that intersect each other and an array of conductive paths between the first and second edges. Each conductive path has a resistance between the first and second edges that is substantially equal.

Optionally, the electrical wafer is a right angle printed circuit board wafer. The housing includes a base portion and a cover portion and the base portion includes at least one slot to receive the wafer. The cover portion includes a plurality of apertures configured to receive and stabilize the wafer.

In another embodiment of the invention, an electrical connector is provided that includes a housing and a plurality of electrical wafers receivable into the housing. Each wafer has a first edge and a second edge that intersect each other and a plurality of conductive paths between the first and second edges. The conductive paths configured such that current flow through the connector is substantially balanced over the plurality of conductive paths.

The invention also provides an electrical wafer for a connector. The wafer has a first edge and a second edge that intersect each other. The first and second edges include an array of contact pads with conductive paths between pairs of the first and second edge contact pads. Each conductive path has a resistance between respective first and second edge contact pads that is substantially equal.

DETAILED DESCRIPTION OF THE INVENTION

Figure 1:
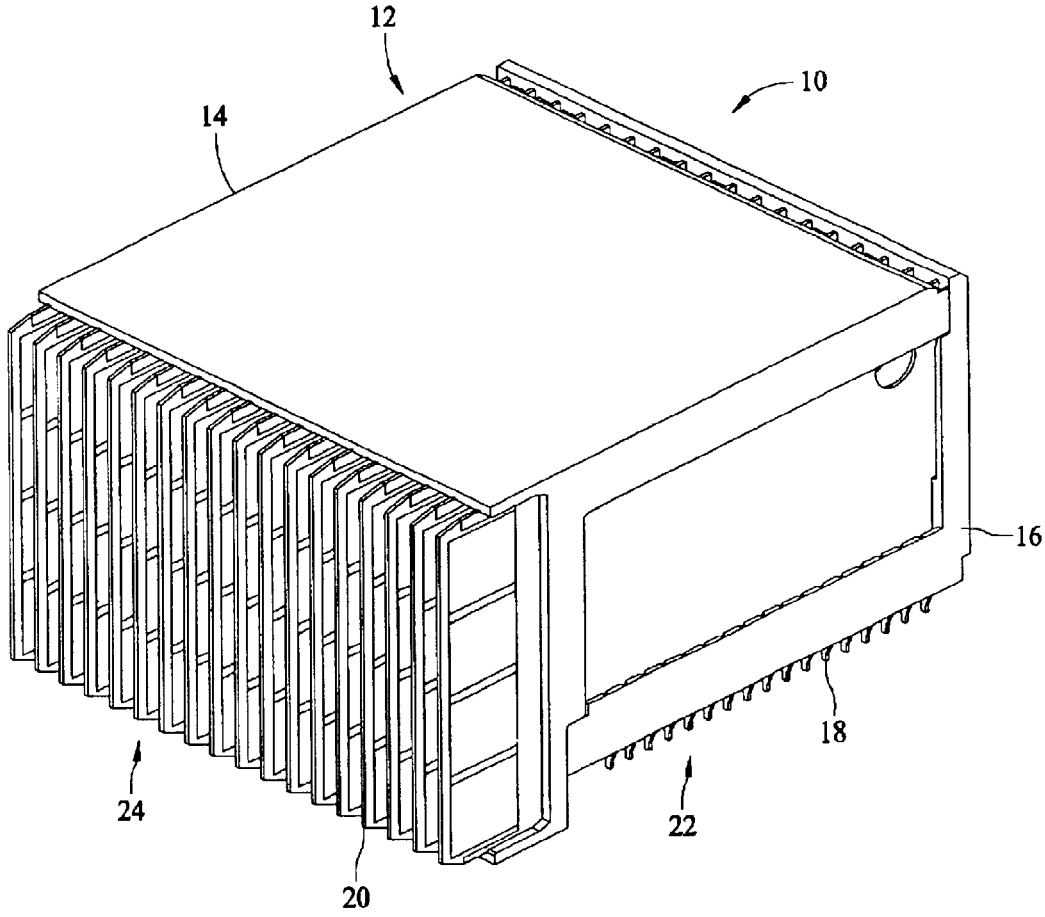
FIG. 1 is a perspective view of a right angle connector formed in accordance with an exemplary embodiment of the present invention.

FIG. 1 illustrates a right angle power connector 10 that includes a housing 12 and a number of electrical wafers 20. The housing 12 includes a cover portion 14 and a base portion 16. The base portion 16 includes a plurality of contacts 18 that form a daughter card interface 22. The contacts 18 have a resilient upper end 19 that receive an edge of wafer 20. The mating face 24 of the connector 10 defines a backplane connector interface. In one embodiment, the connector 10 is referred to as a daughter card assembly that may be used to interconnect a daughter board to a backplane circuit.

Figure 2:
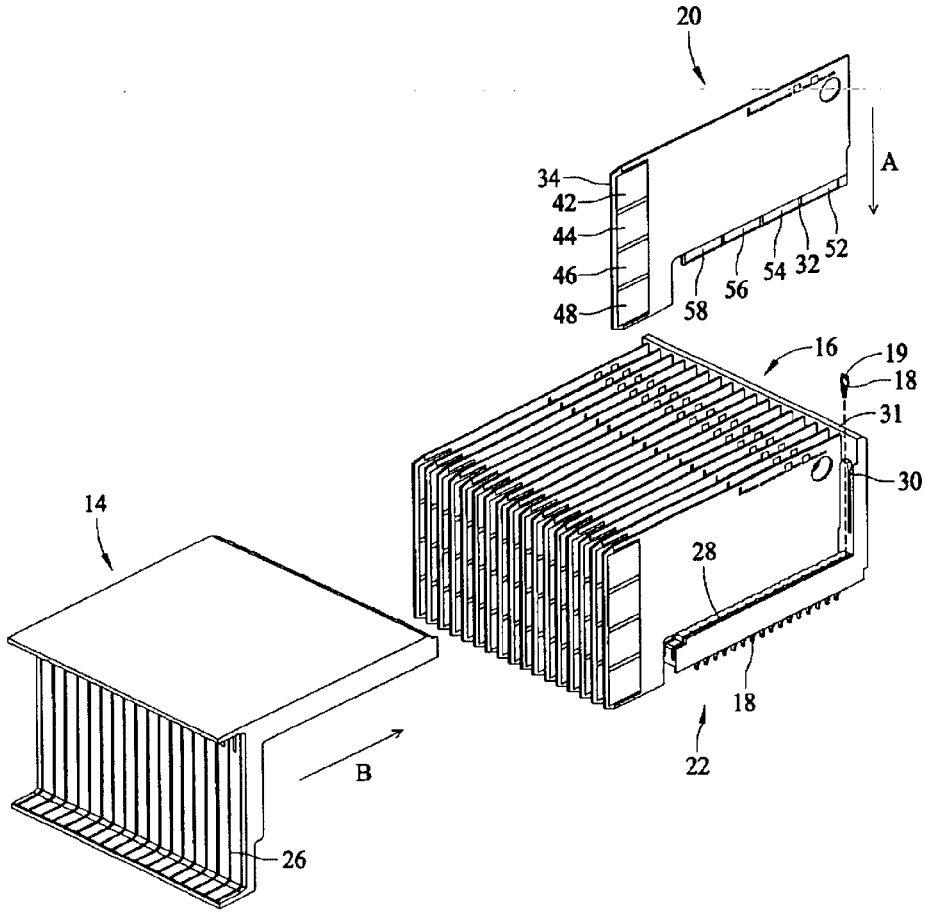
FIG. 2 is an exploded perspective view of the connector of FIG. 1.

FIG. 2 shows an exploded view of the connector 10 of FIG. 1. The housing base 16 includes a plurality of slots 28. The wafers 20 are received into slots 28 with a card edge connection. An alignment slot 30 is formed into the back wall 31 of the housing base 16 at each slot 28.

The connector 10 is modular in construction and includes a plurality of wafers 20. In one embodiment, sixteen wafers 20 are included in the power connector 10, however, fewer or more than sixteen of wafers 20 may be used. Each wafer 20 includes a daughter card edge 32 and a backplane edge 34. The daughter card edge 32 includes a series of contact pads 52, 54, 56, and 58. The backplane edge 34 includes backplane contact pads 42, 44, 46, and 48. For purposes of illustration, only four contact pads are shown along edges 32 and 34 of the wafer 20. It is to be understood, however, that any number of contact pads may be present. Each wafer 20 is received in a slot 28 in the housing base 16. The wafers 20 are inserted into slots 28 in a downward direction indicated by the arrow A. The resilient ends 19 of contacts 18 engage the daughter card contact pads 52, 54, 56, and 58 on the wafer 20 to connect each wafer to the daughter card interface 22. The contacts 18 extend through the housing base 16 to become part of the daughter card interface 22.

The housing cover 14 includes a plurality of alignment apertures 26 that receive the backplane edges 34 of wafers 20. The apertures 26 hold and stabilize the wafers 20 in slots 28 of the housing base 16. After the wafers 20 are installed in the housing base 16, the housing cover 14 is attached by sliding the cover onto the base 16 in the direction of arrow B so that the backplane edges 34 of the wafers 20 extend through the apertures 26.

Figure 3:
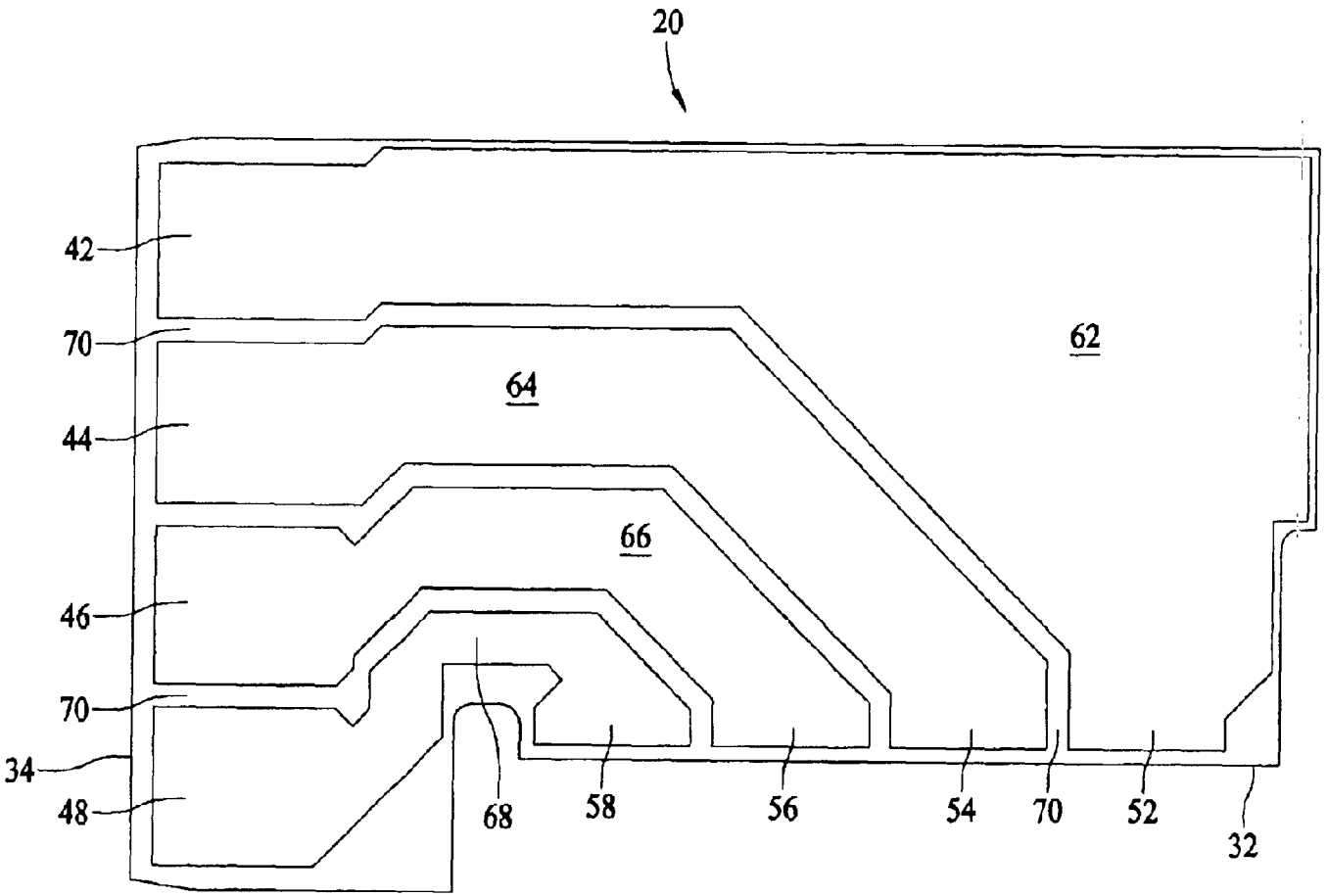
FIG. 3 is top plan view of an exemplary printed circuit board wafer according to one embodiment of the present invention.

FIG. 3 illustrates wafer 20 in detail. In an exemplary embodiment, wafer 20 is a printed circuit board (PCB) wafer. Each wafer 20 includes a number of contact pads along the daughter card edge 32 and a comparable number of contact pads along the backplane edge 34. In the illustrated wafer 20 of FIG. 3, four contact pads 52, 54, 56, and 58 are positioned along the daughter card edge 32 and four contact pads 42, 44, 46, and 48 are positioned along the backplane edge 34. Conductive paths or electrical traces 62, 64, 66, and 68 interconnect pairs of daughter card and backplane contact pads. Trace 62 connects daughter card contact pad 52 with backplane contact pad 42. Similarly, trace 64 connects contact pads 54 and 44. Trace 66 interconnects contact pads 46 and 56 and trace 68 interconnects contact pads 48 and 58. Voided areas 70 on the wafer 20 separate the traces 62 through 68 so that there are distinct current flow paths between the corresponding daughter card and backplane contacts. Alternatively, each wafer 20 can have greater than or fewer than four traces. The wafer 20 is illustrated as L-shaped, however other geometries are also possible.

Daughter card edge 32 and backplane edge 34 are substantially perpendicular to each other. However, in alternative embodiments, it is contemplated that edges 32 and 34 may intersect at other than a right angle. Due to the angular relationship, the current flow paths between corresponding daughter card and backplane contact pads, 42 and 52, 44 and 54, 46 and 56, and 48 and 58 vary in length. To adjust for these flow path length differences, traces 62, 64, 66, and 68 are configured so that the resistance of each trace between the daughter card and corresponding backplane contact pads 42 and 52, 44 and 54, 46 and 56, and 48 and 58 is substantially equal so that current flow is evenly distributed through the wafer 20. The even distribution of current flow through the wafer 20 facilitates the avoidance of hot spots, particularly at the contacts of the backplane interface connector, as will be described, that often results from excessive current flow along flow paths of comparatively lower resistance. With an even distribution of current and a resulting even distribution of heating, more throughput through the connector 10 is possible.

The resistance of the flow paths between the daughter card and backplane contact pads 42 and 52, 44 and 54, 46 and 56, and 48 and 58 can be changed by adjusting the geometric shape of the interconnecting traces 62 through 68. Path width adjustments may be made using the relationship:

$$R = \rho \frac{L}{A} \tag{1}$$

where R is resistance, p is a material conductivity constant, L is path length and A is cross-sectional area.

For a given path, such as the trace 62, the path length between the contact pads 52 and 42 is established so that the trace area is adjusted for making final resistance balancing adjustments. The results of this analysis is reflected in FIG. 3 where the longest trace 62, between daughter card contact pad 52 and backplane contact pad 42, has the longest flow path and also the largest area, while the shortest trace 68, has the shortest length and smallest area. That is, the length of each conductive path or trace 62, 64, 66, and 68 is proportional to a minimum width of the respective trace. On wafer 20 having angular flow paths, successive conductive paths along edges 32 and 34 have increasing lengths and increasing widths, and thus, increasing areas.

Figure 4:
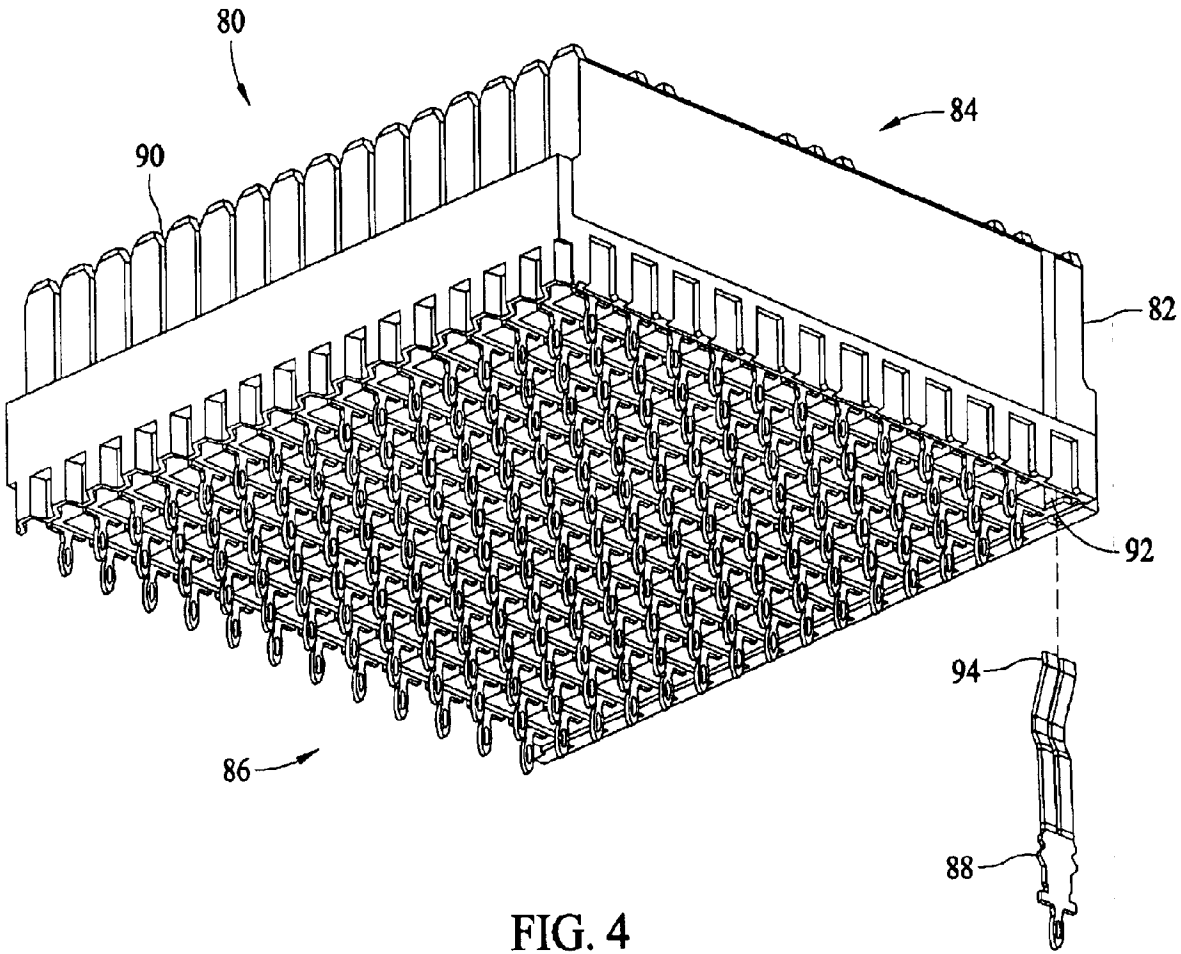
FIG. 4 is a perspective view of an exemplary mating interface connector assembly for the connector of FIG. 1.

FIG. 4 illustrates an exemplary backplane interface mating connector 80 suitable for use with the connector 10. The mating connector 80 includes a housing 82, a connector mating face 84, and a backplane mating face 86. A plurality of backplane contacts 88 are received in contact cavities 92 in the housing 82. Housing 82 also includes a plurality of channels 90 that receive the backplane edges 34 of the wafers 20 when the mating connector 80 is mated with the connector 10. Contacts 88 have ends 94 that extend through the contact cavities 92 to engage the backplane contact pads 42, 44, 46, and 48 on wafer 20 when connectors 10 and 80 are joined.

In use, the connector 10 is attached to a daughter board through the daughter card interface 22. The daughter board typically includes a multi-layered printed circuit board with multiple planes connected with through holes. The various planes interface to a wafer 20 within the connector 10 via the resilient ends 19 of contacts 18. The connector 10 is modular and can be varied in size, e.g. the number of wafers 20, to match the interconnection requirements of the particular application. In one embodiment, the connector 10 can include up to sixteen wafers 20. Alternatively, being modular in form, any number of wafers 20 may be incorporated into the connector 10. Because the flow paths (traces 62, 64, 66, and 68) are resistively matched, current flow is evenly distributed across the contacts 42, 44, 46, and 48 of each wafer 20 to the backplane interface 24. The backplane mating connector 80 completes the connection between the daughter board and the backplane circuit through the terminal contacts 88 in the connector 80. The backplane also typically includes a multi-layered printed circuit board with through hole connections to the various layers. Using the connector 10, power is delivered to the backplane interface 24 evenly distributed over the backplane contacts 42, 44, 46, and 48 of each wafer 20.

Though described with reference to a power connector, it is to be understood that the connector 10 may also be used in signal applications. Further, the connector 10 may include both wafers adapted for signal transmission and wafers designed for power transmission in a common connector.

The embodiments thus described provide a right angle power connector with resistively matched conductive paths through the right angle connector, so that current flow evenly distributed over the flow paths of the connector.

While the invention has been described in terms of various specific embodiments, those skilled in the art will recognize that the invention can be practiced with modification within the spirit and scope of the claims.

What is claimed is:

1. An electrical connector comprising:

a housing; and at least one electrical wafer receivable into said housing, said wafer having a first edge and a second edge, said first edge intersecting said second edge, and an array of conductive paths between said first and second edges, each said conductive path having a resistance between said first and second edges that is substantially equal.

2. The connector of claim 1, wherein said housing comprises a base portion and a cover portion, said base portion including at least one slot, said at least one electrical wafer receivable into said at least one slot, and said cover portion including a plurality of apertures configured to receive and stabilize said at least one electrical wafer.

3. The connector of claim 1, further comprising a mating connector having at least one channel configured to receive one of said first and second edges of said at least one electrical wafer.

4. The connector of claim 1, wherein said housing comprises a slot including a plurality of resilient contacts.

5. The connector of claim 1, wherein said electrical wafer comprises a printed circuit board wafer.

6. The connector of claim 1, wherein each said conductive path has a length that is proportional to its minimum width.

7. The connector of claim 1, wherein said conductive paths are arrayed sequentially along one side of said wafer such that successive conductive paths have an increasing length and an increasing width.

8. The connector of claim 1, wherein said conductive paths are arrayed sequentially along one side of said wafer such that successive conductive paths have an increasing area.

9. The connector of claim 1, wherein said first and second edges are substantially perpendicular to each other.

10. An electrical connector comprising:

a housing; and a plurality of electrical wafers receivable into said housing, each said wafer having a first edge and a second edge, said first edge intersecting said second edge, and a plurality of conductive paths between said first and second edges, said conductive paths configured such that current flow through the connector is substantially balanced over said plurality of conductive paths.

11. The connector of claim 10, wherein said housing comprises a base portion and a cover portion, said base portion including a plurality of slots, said plurality of electrical wafers receivable into said plurality of slots, and said cover portion including a plurality of apertures configured to receive and stabilize said plurality of electrical wafers.

12. The connector of claim 10, further comprising a mating connector having a plurality of channels, each said channel configured to receive one of said first and second edges of one of said plurality of wafers.

13. The connector of claim 10, wherein said housing comprises a slot including a plurality of resilient contacts.

14. The connector of claim 10, wherein each said wafer comprises a printed circuit board wafer.

15. The connector of claim 10, wherein each said conductive path has a length that is proportional to its minimum width.

16. The connector of claim 10, wherein said conductive paths are arrayed sequentially along one side of each said wafer such that successive conductive paths have an increasing length and an increasing width.

17. The connector of claim 10, wherein said conductive paths are arrayed sequentially along one side of each said wafer such that successive conductive paths have an increasing area.

18. The connector of claim 10, wherein said first and second edges are substantially perpendicular to each other.

19. An electrical wafer comprising a first edge and a second edge, said first edge intersecting said second edge, said first and second edges including an array of contact pads thereon, and conductive paths between pairs of said first and second edge contact pads, each said conductive path having a resistance between respective first and second edge contact pads that is substantially equal.

20. The wafer of claim 19, wherein said conductive paths are arrayed sequentially along one side of said wafer such that successive conductive paths have an increasing area.

* * * * *